United States Patent [19]

Axtell

[11] Patent Number: 4,824,097

[45] Date of Patent: Apr. 25, 1989

[54] PUPPET-ON-THE-ARM ILLUSION DEVICE

[76] Inventor: Stephen B. Axtell, 272 Dalton St., Ventura, Calif. 93003

[21] Appl. No.: 154,387

[22] Filed: Feb. 10, 1988

[51] Int. Cl.[4] ..... A63J 3/00; A63H 3/14

[52] U.S. Cl. ..... 272/8 N; 446/26; 446/327

[58] Field of Search ..... 446/327, 328, 329, 268, 446/26, 28; 272/8 N, 8 R, 9

[56] References Cited

U.S. PATENT DOCUMENTS

| | | | |
|---|---|---|---|
| 2,725,670 | 12/1955 | Hodes | 446/327 |
| 3,526,990 | 9/1970 | Edmonds | 272/8 R X |
| 4,304,065 | 12/1981 | Baiera | 446/327 |
| 4,695,265 | 9/1987 | Clark | 446/329 |

*Primary Examiner*—Mickey Yu

*Attorney, Agent, or Firm*—Marvin E. Jacobs

[57] ABSTRACT

An arm-mounted device for producing a puppet-on-the-arm illusion includes a fake at least partial forearm and hand member in the form of a glove having a hand portion and wrist and partial forearm portion extending therefrom, and a connector member operable for attaching the fake member directly to the forearm of a puppeteer next to the elbow thereof in a cantilevered fashion. Once the fake member is so attached to the puppeteer's forearm, the forearm is bent upward and a forearm-length puppet slipped over the hand and forearm of the puppeteer, the fake member will then define an extension from an upper portion of the puppeteer's arm so as to create the illusion of a glove-covered hand and forearm supporting the puppet on the puppeteer's forearm proximate the elbow thereof.

21 Claims, 1 Drawing Sheet

PUPPET-ON-THE-ARM ILLUSION DEVICE

BACKGROUND OF THE INVENTION

The present invention relates generally to toys and novelties and, more particularly, is concerned with an illusion device attachable to the forearm of a puppeteer and usable in conjunction with a forearm-length puppet in a manner which will create an illusion that the puppet is sitting and moving in an unsupported fashion on the outstretched arm of the puppeteer.

Puppets adapted to be positioned over the forearm and hand of a puppeteer and manipulated by the puppeteer's hand and fingers have long been known in the art. Some representative examples of puppets of this type in the prior art are the ones disclosed in U.S. patents to Lemieux (U.S. Pat. No. 1,641,175) and Synder (U.S. Pat. No. 2,795,896). Puppets of this general type share one common characteristic in that no attempt is made to hide the fact that the puppeteer's forearm is supporting the puppet and his or her hand and fingers are being used to manipulate or animate the puppet.

More recently, several puppets have appeared in the prior art which share a characteristic that is just the opposite of the one mentioned above. Specifically, these puppets attempt to intentionally create the illusion that the puppeteer's hand is being used solely to grasp the puppet or his or her arm is being used solely to support an object upon which the puppet is standing. Thus, the appearance or illusion projected to witnesses by these puppets is that the puppeteer's hand or arm cannot possibly be the means by which the puppet is being manipulated and so a mystery is created as to how the puppet is being worked.

The puppets having this characteristic in common are the ones disclosed in U.S. Patents to Baiera (U.S. Pat. No. 4,304,065) and Edmonds (U.S. Pat. No. 3,526,990). Specifically, in the Baiera patent a walking hand puppet is disclosed. The puppet has a body with finger-insertable appendages and a non-functional or fake glove on the top of the body for creating the illustion that the puppeteer is only grasping the puppet with his or her hand inserted into the glove and thus could not be using the hand to manipulate the puppet. However, instead, the glove is filled with stuffing material and has an internal passage which leads into the body of the puppet. The hand of the puppeteer is inserted through the glove passage into the puppet body with the puppeteer's fingers inserted into the appendages to manipulate them in simulation of walking or crawling.

In the Edmonds patent an artificial arm and hand fastened to the underside of a rigid platform is disclosed. The platform has an opening located proximate the elbow end of the artificial arm which serves as a pocket to receive the puppeteer's own elbow from above the platform. Straps anchored to the platform at the location of the opening are extendable about the puppet-supporting hand and arm of the puppeteer to also support the platform therefrom. The puppet being separate from the platform is placed over the hand and arm of the puppeteer after the platform is attached thereto. When placed over the puppeteer's hand and arm, the puppet conceals the same. The illusion is created that the puppet is standing unassisted on the platform and the puppeteer's arm and hand are only holding the platform. Instead, the puppeteer's hand is inside the puppet's head where it can manipulate the same. The artificial arm and hand can be formed either of a plastic material, such as latex, rubber or vinyl, or a sleeve stuffed to resemble an arm with a glove attached to the sleeve and having flexible wire inserted therein making it possible to bend the fingers of the glove around the edge of the platform.

The puppets of the aforecited Baiera and Edmonds patents are certainly a step in the right direction toward increasing the entertainment quality or value of puppets in general. However, these particular versions have certain drawbacks which serve to minimize rather than maximize the potential realistic effect that could be created by puppets of this type. First, the puppet of the Baiera patent has limited animation potential. Second, the mere location of the Baiera puppet so near to the fingers of the fake glove is certain to arouse immediately the suspensions of those being entertained that it is the fingers of the puppeteer which are manipulating the puppet's appendages. In the Edmonds arrangement, the use of the platform between the puppet and the arm of the puppeteer would tend to distract from the play or presentation itself. The audience would focus their attention on trying to figure out whether something is mounted on the platform under the puppet instead of concentrating on the presentation being given by the puppeteer. Also, the Edmonds arrangement generally lacks in realism. For instance, the puppet in Edmonds appears to resemble a small boy. However, a small boy sitting on a platform supported on a person's arm has no readily recognizable real-life counterpart. In addition, the use of a platform in the Edmonds arrangement is awkward and cumbersome.

Consequently, a need still exists for a puppet illusion which is more realistic and tends to maximize and enhance its entertainment quality and value, but is one which is relatively simple in construction.

SUMMARY OF THE INVENTION

The present invention provides a puppet-on-the-arm illusion device designed to satisfy the aforementioned needs. The illusion device of the present invention is simple in design making it easy to produce the effect of realism in the puppet. The effect is so realistic that observers cannot readily decipher how the illusion is created; thus, the effect is also of a magic trick nature.

Basically, the illusion device employs a puppet, such as a bird, with a fake forearm and hand member in the form of a glove having a hand portion and a wrist and forearm portion extending therefrom and a contoured connector member attached to the fake member. The illusion device is used by coupling its connector member to the forearm of the puppeteer next to the elbow.

In one embodiment, coupling of the connector member is achieved by applying fastening straps about the connector and forearm. The forearm is then bent upward so that the fake member will define an extension from the upper arm portion of the puppeteer for creating the illusion of a glove-covered hand, wrist and forearm. The puppet is then slipped over the coupled portion of the connector member and the hand, wrist and forearm of the puppeteer.

When the puppet is a bird, the result will look like a forearm and hand dressed by a long glove resembling a bird glove. The fact that real bird trainers use gloves gives more reason and credibility to the use of a glove for the fake forearm and hand. The effect seems very natural since a counterpart to the illusion device is found in the real world: a bird perched on the arm of a bird trainer. Also, the puppet being positioned on the center of the puppeteer's arm makes it seem impossible for the puppeteer to be animating the puppet. This greatly improves the quality and effectiveness of the presentation.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
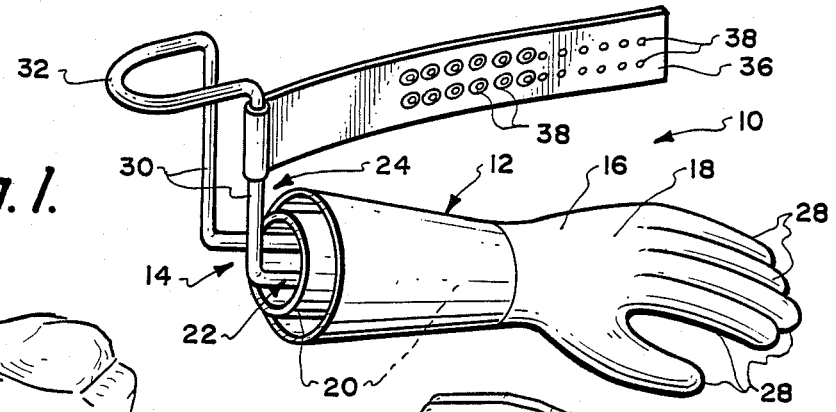
FIG. 1 is a perspective view of a puppet-on-the-arm illusion device constructed in accordance with the principles of the present invention, the device being illustrated before attachment to the puppeteer's forearm.
Figure 2:
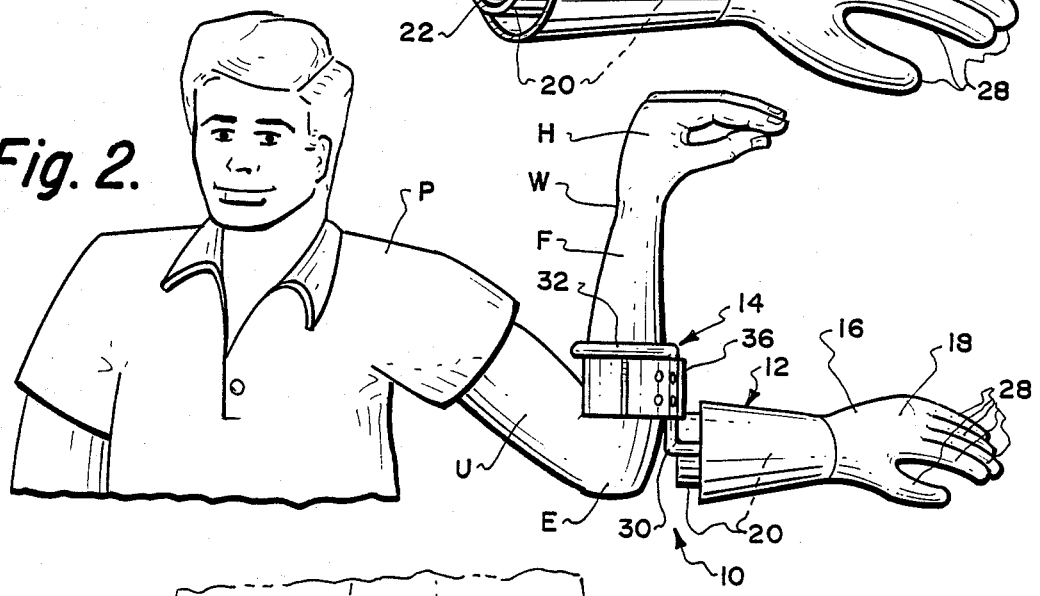
FIG. 2 is a front elevational view of the illusion device after attachment to the puppeteer's forearm and before application of a puppet over the hand and forearm.

Referring now to the drawings, and particularly to FIG. 1, there is shown a preferred embodiment of an illusion device, being indicated generally by the numeral 10 and constructed in accordance with the principles of the present invention. The illusion device 10 basically includes a fake partial forearm and hand member 12 and a contoured connector member 14 attached to the fake member 12. The fake forearm and hand member 12 is in the form of a glove 16 having a hand portion 18 and wrist and partial forearm portion 20. As shown in FIG. 2, the illusion device 10 is installed by securing its connector member 12 to the forearm F of a puppeteer P next to his or her elbow E. The forearm F is then bent upward so that the fake member 12 will define an extension from the upper arm portion U of the puppeteer P for creating the illusion of a glove-covered hand, wrist and forearm.

Figure 4:
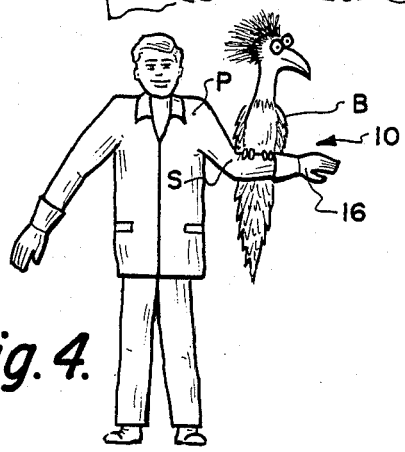
FIG. 4 is a front elevational view of a puppeteer having a bird puppet and the illusion device mounted on an arm wearing a jacket sleeve.
Figure 5:
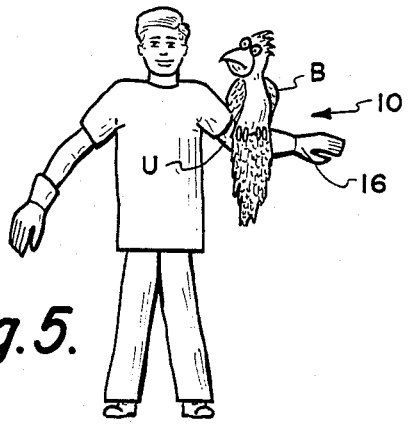
FIG. 5 is another front elevational view of a puppeteer having the bird puppet and the illusion device mounted on a bare arm.

Referring to FIGS. 4 and 5, a forearm-length puppet, such as a bird puppet B, is then slipped over the secured portion of the connector member 14 and the hand H, wrist W and forearm F of the puppeteer P. The illusion is produced or created that a glove-covered hand and forearm supports the puppet B on the puppeteer's forearm proximate his or her elbow E. It should be understood that the puppet B can either be separate from the illusion device 10 o integrated into its construction.

The puppeteer P can use the illusion device with or without a shirt or jacket sleeve S covering his or her forearm F. If a shirt or jacket is worn as illustrated in FIG. 4, a hole (not shown) should be made in the center of the sleeve S through which the puppeteer's hand H, wrist W and forearm F would fit before entering the body of the bird puppet B. In FIG. 5, the bird puppet B and illusion device 10 are shown associated with a puppeteer's uncovered, bare forearm F. Some of the feathers on the bird puppet B can be used to conceal the entrance of the forearm F into the body of the bird puppet. Because a glove 16 is employed by the illusion device 10, the illusion device can be used by a puppeteer of any race, regardless of skin color.

Figure 3:
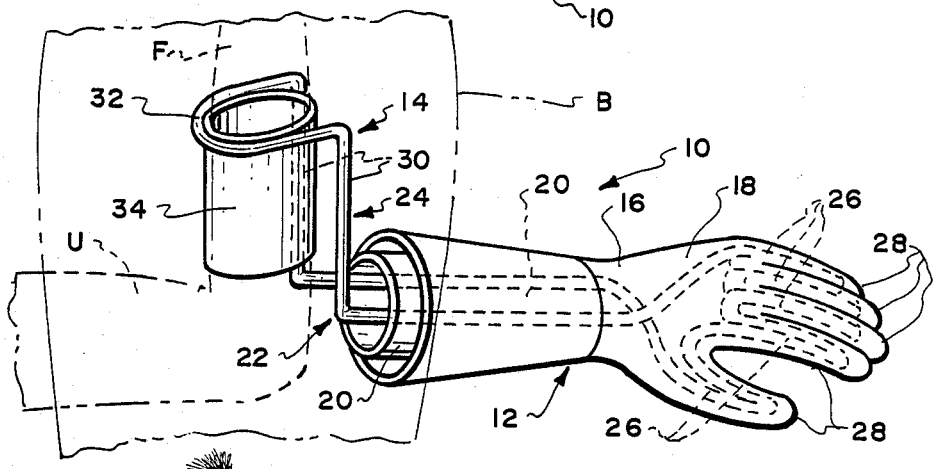
FIG. 3 is a perspective view of a slightly different version of the puppet-on-the-arm illusion device of the present invention.

More particularly, the attaching or mounting means of the illusion-producing device 10 in the form of the connector member 14 has a first portion 22 attached to the fake member 12 and a second portion 24 extending therefrom and being adapted for coupling to the puppeteer's forearm F next to the elbow E. The connector member 14 is preferably composed of bent metal tubing as illustrated in FIGS. 1–3.

The first portion 22 of the connector member 14 which is attached to and extends into the glove 16 can have bendable wire-like elements 26 thereon which will extend into and hold the desired shape of the fingers 28 of the glove 16. Thus, for example, the glove fingers 28 can be bent around objects such as a leash for the bird or other kind of puppet B.

The second portion 24 of the connector member 14 which extends from the glove 16 is formed of at least one and preferably a pair of generally straight elongated elements 30. The straight elements 30 are spaced from one another and extend generally orthogonally relative to the first portion 22, adapting the elements 30 to extend along a lower side of the puppeteer's forearm F next to the elbow E thereof when the connector member 14 is mounted to the puppeteer's forearm, as can be seen in FIG. 2.

The second portion 24 of the connector member 14 also is formed of a looped element 32 fixedly connected to the outer ends of the straight elements 30. The looped element 32 is bent in a predefined contour to extend from the lower side of the puppeteer's forearm F about an upper side of the puppeteer's forearm and back to the lower side thereof. In such relationship along and about the forearm F, the connector member second portion 24 is adapted to mount the fake member 12 directly to the puppeteer's forearm F in a hanging, cantilevered fashion, as can be observed in FIG. 2.

Alternatively, as shown in FIG. 3, the second portion 24 of the connector member 14 can incorporate a hollow tubular sleeve 34 which is open at its opposite ends and adapted to receive therethrough the puppeteer's forearm F. In the embodiment illustrated, the sleeve 34 is fixed to the straight elements 30 of the connector member second portion 24. As seen in dotted outline in FIG. 3, the lower foot region of the bird puppet B will encompass and conceal the sleeve 34 as well as the straight and looped elements 30, 32 of the connector member 14.

Finally, securing means is provided for attaching the second portion 24 of the connector member 14 directly to the puppeteer's forearm F. By way of example, the securing means can be one or more straps 36 adapted to be applied about the straight element 30 of the second portion 24 of the connector member and the forearm F of the puppeteer P next to the elbow E for securing the fake member 14 directly to the puppeteer's forearm F. As depicted in Figs. 1 and 2, the elongated securing strap 36 is permanently attached to one of the straight elements 30 and is capable of encircling the straight elements 30 and the puppeteer's forearm F. The strap 36 preferably has fastening elements 38 thereon, such as snaps, loop and hook, or Velcro patches, which adapt the strap 36 to be fastened to itself. In the alternative arrangement depicted in FIG. 3, the sleeve 34 would perform the function of securing or retaining the connector member 14 and fake arm 12 mounted to the puppeteer's forearm F due to the fact that the sleeve 34 encircles the same above the bent elbow.

When the puppet is a bird, the result will look like a forearm and hand dressed by a long glove resembling a bird glove. The fact that real bird trainers use gloves gives more reason and credibility to the use of a glove for the fake forearm and hand. The effect seems very natural since a counterpart to the illusion device is found in the real world: a bird perched on the arm of a bird trainer. Also, the puppet being positioned on the center of the puppeteer's arm makes it seem impossible for the puppeteer to be animating the puppet. This greatly improves the quality and effectiveness of the presentation.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. An arm-mounted device for producing a puppet-on-the-arm illusion, comprising:

(a) a fake at least partial forearm and hand member in the form of a glove having a hand portion and writs and partial forearm portion extending therefrom; and (b) means operable for attaching said fake member directly to the forearm of a puppeteer next to the elbow thereof for securing said fake member to the puppeteer's forearm such that when the forearm is bent upward and a forearm-length puppet slipped over the hand and forearm of the puppeteer said fake member will define an extension from an upper portion of the puppeteer's arm for creating the illusion of a glove-covered hand and forearm supporting the puppet on the puppeteer's forearm proximate the elbow thereof;

(c) said means operable for attaching said fake member including a connector having a first portion attached to said fake member and a second portion extending therefrom and being adapted for coupling to the puppeteer's forearm next to the elbow thereof;

(d) said second portion of said connector member including at least one generally straight elongated element adapted to extend along a lower side of the puppeteer's forearm next to the elbow thereof.

2. The illusion-product device of claim 1 wherein said second portion of said connector member also includes a looped element fixedly connected to said straight element and adapted to extend from the lower side of the puppeteer's forearm about an upper side of the puppeteer's forearm and back to the lower side therof such that said second portion is adapted to hang sad fake arm from the puppeteer's forearm in a cantileverd fashion.

3. The illusion-producing device of claim 1 wherein said second portion of said connector member includes a pair of said straight elements.

4. The illusion-producing device of claim 3 wherein said second portion of said connector member also includes a sleeve open at its opposite ends, attached to said straight elements and adapted to receive the puppeteer's forearm therethrough.

5. The illusion-producing device of claim 1 wherein said means operable for attaching said fake member also includes securing means adapted to be applied about said straight element of said connector and the forearm of the puppeteer next to the elbow for securing said fake member directly to the puppeteer's forearm.

6. The illusion-producing device of claim 5 wherein said securing means is at least one elongated strap capable of encircling said straight element and the puppeteer's forearm and having fastening elements thereon adapting said strap to be fastened to itself.

7. The illusion-producing device of claim 6 wherein said strap is attached at one end to said straight element.

8. An arm-mounted device for producing a puppet-on-the-arm illusion, comprising:

(a) a fake at least partial forearm and hand member in the form of a glove having a hand portion and wrist and partial forearm portion extending therefrom; and (b) a tubing-type connector member attached to and extending from said fake member, said connector member being bent in a predefined contour for mounting said fake member directly to the forearm of a puppeteer next to the elbow thereof in a cantilevered fashion such that when the forearm is bent upward and a forearm-length puppet slipped over the hand and forearm of the puppeteer said fake member will define an extension from an upper portion of the puppeteer's arm for creating the illusion of a glove-covered hand and forearm supporting the puppet on the puppeteer's forearm proximate the elbow thereof.

9. The illusion-producing device of claim 8 wherein said connector member has a first portion attached to said fake member and a second portion extending therefrom and being adapted for coupling to the puppeteer's forearm next to the elbow thereof.

10. The illusion-producing device of claim 9 wherein said second portion of said connector member includes a sleeve open at its opposite ends and adapted to receive the puppeteer's forearm therethrough.

11. The illusion-producing device of claim 9 wherein said second portion of said connector member includes a pair of generally straight elongated elements adapted to extend along a lower side of the puppeteer's forearm next to the elbow thereof.

12. The illusion-producing device of claim 11 wherein said second portion of said connector member also includes a sleeve open at its opposite ends, attached to said straight elements and adapted to receive the puppeteer's forearm therethrough.

13. The illusion-producing device of claim 11 wherein said second portion of said connector member also includes a looped element fixedly connected to outer ends of said straight elements and adapted to extend from the lower side of the puppeteer's forearm about an upper side of the puppeteer's forearm and back to the lower side thereof such that said second portion is adapted to hang said fake arm from the puppeteer's forearm in the cantilevered fashion.

14. The illusion-producing device of claim 11 further comprising at least one elongated strap capable of encircling said straight elements and the puppeteer's forearm for securing said fake member directly to the puppeteer's forearm.

15. The illusion-producing device of claim 14 wherein said strap has fastening elements thereon adapting said strap to be fastened to itself.

16. The illusion-producing device of claim 14 wherein said strap is attached at one end to one of said straight elements.

17. The illusion-producing device of claim 9 further comprising a generally forearm-length puppet attached to said second portion of said connector member.

18. The illusion-producing device of claim 9 wherein said first portion of said connector member includes bendable wire-like elements extending into and for holding the shape of fingers on the hand portion of said glove.

19. An arm-mounted device for producing a puppet-on-the-arm illusion, comprising:

(a) a fake at least partial forearm and hand member in the form of a glove having a hand portion and wrist and partial forearm portion extending therefrom;

(b) means operable for attaching said fake member directly to the forearm of a puppeteer next to the elbow thereof for securing said fake member to the puppeteer's forearm such that when the forearm is bent upward and a forearm-length puppet slipped over the hand and forearm of the puppeteer said fake member will define an extension from an upper portion of the puppeteer's arm for creating the illusion of a glove-covered hand and forearm supporting the puppet on the puppeteer's forearm proximate the elbow thereof;

(c) said means operable for attaching said fake member including a connector member having a first portion attached to said fake member and a second portion extending therefrom and being adapted for coupling to the puppeteer's forearm next to the elbow thereof;

(d) said means operable for attaching said fake member also including securing means adapted to be applied about said second portion of said connector member and the forearm of the puppeteer next to the elbow for securing said fake member directly to the forearm.

20. An arm-mounted device for producing a puppet-on-the-arm illusion, comprising:

(a) a fake at least partial forearm and hand member in the form of a glove having a hand portion and wrist and partial forearm portion extending therefrom;

(b) means operable for attaching said fake member directly to the forearm of a puppeteer next to the elbow thereof for securing said fake member to the puppeteer's forearm such that when the forearm is bent upward and a forearm-length puppet slipped over the hand and forearm of the puppeteer said fake member will define an extension from an upper portion of the puppeteer's arm for creating the illusion of a glove-covered hand and forearm supporting the puppet on the puppeteer's forearm proximate the elbow thereof;

(c) said means operable for attaching said fake member including a connector member having a first portion attached to said fake member and a second portion extending therefrom and being adapted for coupling to the puppeteer's forearm next to the elbow thereof; and (d) a generally forearm-length puppet attached to said second portion of said connector member.

21. The illusion-producing device of claim 20 wherein said second portion of said connector member includes a sleeve member adapted to receive the puppeteer's forearm therethrough.

22. An arm-mounted device for producing a puppet-on-the-arm illusion, comprising:

(a) a fake at least partial forearm and hand member in the form of a glove having a hand portion and wrist and partial forearm portion extending therefrom; and (b) means operable for attaching said fake member directly to the forearm of a puppeteer next to the elbow thereof for securing said fake member to the puppeteer's forearm such that when the forearm is bent upward and a forearm-length puppet slipped over the hand and forearm of the puppeteer said fake member will define an extension from an upper portion of the puppeteer's arm for creating the illusion of a glove-covered hand and forearm supporting the puppet on the puppeteer's forearm proximate the elbow thereof;

(c) said means operable for attaching said fake member including a connector member having a first portion attached to said fake member and as second portion extending therefrom and being adapted for coupling to the puppeteer's forearm next to the elbow thereof;

(d) said first portion of said connector member including bendable wire-like elements extending into and for holding the shape of fingers on the hand portion of said glove.

* * * * *